US011729566B2

(12) United States Patent
Tao

(10) Patent No.: US 11,729,566 B2
(45) Date of Patent: Aug. 15, 2023

(54) JUDGING CIRCUIT FOR POSITIVE AND NEGATIVE TERMINALS OF MIC OF EARPHONE AND METHOD THEREOF, AND ELETRONIC DEVICE

(71) Applicant: SHANGHAI YAOHUO MICROELECTRONICS Co., Ltd., Shanghai (CN)

(72) Inventor: Hongxia Tao, Shanghai (CN)

(73) Assignee: SHANGHAI YAOHUO MICROELECTRONICS CO., LTD., Shanghai (CN)

( * ) Notice: Subject to any disclaimer, the term of this patent is extended or adjusted under 35 U.S.C. 154(b) by 197 days.

(21) Appl. No.: 17/284,458

(22) PCT Filed: Mar. 4, 2020

(86) PCT No.: PCT/CN2020/077832
§ 371 (c)(1),
(2) Date: Apr. 10, 2021

(87) PCT Pub. No.: WO2020/192376
PCT Pub. Date: Oct. 1, 2020

(65) Prior Publication Data

US 2022/0007122 A1 Jan. 6, 2022

(30) Foreign Application Priority Data

Mar. 27, 2019 (CN) ..... 201910239003.3

(51) Int. Cl.
*H04R 5/04* (2006.01)
*H04R 1/10* (2006.01)
*H04R 29/00* (2006.01)

(52) U.S. Cl.
CPC ..... *H04R 29/001* (2013.01); *H04R 1/1041* (2013.01); *H04R 5/04* (2013.01); *H04R 2420/05* (2013.01)

(58) Field of Classification Search
CPC ..... H04R 2420/05; H04R 1/1041; H04R 5/04
See application file for complete search history.

(56) References Cited

U.S. PATENT DOCUMENTS

2019/0257869 A1* 8/2019 Lee ..... H01R 9/2425

* cited by examiner

*Primary Examiner* — Ping Lee
(74) *Attorney, Agent, or Firm* — NZ Carr Law Office

(57) ABSTRACT

The present invention provides a judging circuit including a comparison module and a control module for positive and negative terminals of an earphone MIC and a method thereof, and an electronic device; the control module controls any one first terminal of two terminals of the MIC to inject an excitation current, and control the other second terminal of the two terminals to be connected to the ground via an analog switch, also to judge whether the first terminal and the second terminal is the positive terminal or the negative terminal according to comparison result information; the comparison module compares the current voltage with a preset reference voltage value after excitation current is injected into the first terminal and the second terminal is grounded to obtain comparison result information and to send it to the connected control module. The present invention improves the flow and process without two sets of detection device.

20 Claims, 5 Drawing Sheets

JUDGING CIRCUIT FOR POSITIVE AND NEGATIVE TERMINALS OF MIC OF EARPHONE AND METHOD THEREOF, AND ELETRONIC DEVICE

TECHNICAL FIELD

The present invention relates to the field of Type-C earphone, in particular, to a judging circuit for positive and negative terminals of an earphone MIC and an electronic device capable of being connected to the earphone.

BACKGROUND

Type-C earphone can be understood as the external interface of the earphone is based on the USB Type-C specification, wherein USB Type-C, abbreviated as USB-C, is a hardware interface specification for Universal Serial Bus (USB). The external interface of the Type-C earphone can support blind insertion, that is, both positive and reverse connections. However, in an electronic device of the earphone, only by judging the positive and negative electrodes of the MIC in the currently inserted earphone, i.e., judging whether the MIC is positively connected or reversely connected, can the signal be correctly transmitted.

In the prior art, in order to determine whether the MIC is positively connected or reversely connected, the following two steps can be performed in sequence when the earphone is inserted: first step of controlling the second terminal of the MIC to be connected to the ground via the analog switch, e.g., connecting the SBU2 pin connected to the second terminal to the ground via the analog switch, then injecting an excitation current into the first terminal of the MIC, e.g., injecting the excitation current into the SBU1 pin connected to the first terminal, and then using ADC to detect the voltage V1 of SBU1 pin at this time; the second step of controlling the first terminal of the MIC to the ground via the analog switch, e.g., connecting the SBU1 pin connected to the first terminal to the ground via the analog switch, then injecting the same excitation current into the second terminal of the MIC, e.g., injecting the excitation current into the SBU2 pin connected to the second terminal, and then using ADC to detect the voltage V2 of SBU2 pin at this time.

At this time, if V2>V1>a preset value, it can be judged that the first terminal of the MIC connected to the SBU1 pin is negative, and the second terminal of the MIC connected to the SBU2 pin is positive; if V1>V2>the preset value, it can be judged that the first terminal of the MIC connected to the SBU1 pin is positive, and the second terminal of the MIC connected to the SBU2 pin is negative. The preset value can be an empirical value.

It can be seen that in the prior art, the process of judging the positive and reverse connection of MIC is more complicated, e.g., requiring to control the injection of excitation current twice, to control the grounding twice and to detect the voltage twice; and in order to achieve two detections, two sets of ADC detection device are required, so that the cost is also high.

SUMMARY

The present invention provides a judging circuit for positive and negative terminals of an earphone MIC, so as to solve the problem of complicated processing flow and high cost.

According to a first aspect of the present invention, a judging circuit for positive and negative terminals of an earphone MIC is provided, the earphone being a Type-C earphone, wherein a negative terminal of the MIC is connected to a common terminal of the two speaker circuits, the judging circuit for positive and negative terminals of an earphone MIC including a comparison module and a control module;

the control module is directly or indirectly connected to two terminals of the MIC, is configured to control any one first terminal of the two terminals of the MIC to inject an excitation current, and control the other second terminal of the two terminals of the MIC to be connected to the ground;

the comparison module is connected to at least one of two speaker circuits of the earphone to collect a current voltage of a corresponding position in the speaker circuit;

the comparison module is configured to compare the current voltage with a preset reference voltage value after the excitation current is injected into the first terminal and the second terminal is grounded to obtain comparison result information;

the comparison module is further connected to the control module to send the comparison result information to the control module;

the control module is further configured to judge whether the first terminal and the second terminal is the positive terminal or the negative terminal according to the comparison result information.

Optionally, the comparison result information includes a first comparison result information, and the comparison module is specifically configured to send the first comparison result information to the control module when the current voltage is higher than the reference voltage value;

the control module is specifically configured to determine, according to the first comparison result information, that the first terminal is the negative terminal of the MIC and the second terminal is the positive terminal of the MIC.

Optionally, the comparison result information includes a second comparison result information, and the comparison module is specifically configured to send the second comparison result information to the control module when the current voltage is lower than the reference voltage value;

the comparison module is specifically configured to determine, according to the second comparison result information, that the first terminal is the positive terminal of the MIC and the second terminal is the negative terminal of the MIC.

Optionally, the comparison module includes a comparator, a first input terminal of the comparator inputs the current voltage, a second input terminal of the comparator inputs the reference voltage value, and an output terminal of the comparator is connected to the control module to send the comparison result information to the control module.

Optionally, the first input terminal of the comparator is connected to the common terminal of the two speaker circuits via the earphone speaker.

Optionally, the control module is further configured to control the positive terminal of the MIC to be connected to an MIC pin of an audio processing module, after determining the positive terminal and the negative terminal of the first terminal and the second terminal, to employ the MIC pin to receive a signal transmitted by the MIC and control the negative terminal of the MIC to be connected to a ground pin of the audio processing module.

According to a second aspect of the present invention, an electronic device capable of being connected to an earphone, including the judging circuit for positive and negative terminals of an earphone MIC of the first aspect and optional solutions thereof.

Optionally, the electronic device capable of being connected to an earphone further includes an interface assembly, the interface assembly connecting the control module and the comparison module respectively;

when the earphone is connected to the interface assembly, the control module is respectively connected to two terminals of the MIC through the interface assembly;

when the earphone is connected to the interface assembly, the comparison module is connected to at least one of the two speaker circuits through the interface assembly.

Optionally, the electronic device is any one of a mobile phone, a computer, a tablet computer, and a call device.

According to a third aspect of the present invention, a judging method for positive and negative terminals of an earphone MIC is provided, the earphone being a Type-C earphone, wherein a negative electrode of the MIC is connected to the two speaker circuits, the judging method for positive and negative terminals of an earphone MIC including:

controlling any one first terminal of the two terminals of the MIC to inject an excitation current, and controlling the other second terminal of the two terminals of the MIC to be connected to the ground;

collecting a current voltage of a corresponding position in at least one of the speaker circuits;

comparing the current voltage with a preset reference voltage value;

determining that the first terminal is the negative terminal of the MIC and the second terminal is the positive terminal of the MIC if the current voltage is higher than the preset reference voltage value;

determining that the first terminal is the positive terminal of the MIC and the second terminal is the negative terminal of the MIC if the current voltage is lower than the preset reference voltage value.

For the judging circuit for positive and negative terminals of an earphone MIC and a method thereof, and an electronic device provided by the present invention, by exploring the circuit architecture of the Type-C earphone, it is found that the negative electrode of the MIC is connected to the two speaker circuits, and further, the control module of the present invention may know in advance that the collected voltage is actually the voltage corresponding to the negative terminal of the MIC, wherein:

when $V_{MIC}$ represents the voltage drop across the MIC, $V_{switch}$ represents the voltage drop of the analog switch and $V_x$ represents the current measured voltage, and $V_{ref}$ represents the preset voltage value associated with the minimum reverse voltage, then:

if the first terminal input with the excitation current is the positive terminal of the MIC, $V_x$ is the detected voltage of the negative terminal of the MIC, and $V_x=V_{switch}$, and since $V_{ref}$ is much larger than $V_{switch}$ at this time, $V_x$ is much smaller than $V_{ref}$, then it can be inferred that the first terminal is the positive terminal of the MIC if the detected $V_x$ is smaller than $V_{ref}$;

if the first terminal input with the excitation current is the negative terminal of the MIC and the detected $V_x$ is the voltage of the negative terminal of the MIC, i.e., if $V_x$ is larger than the minimum reverse voltage, i.e., $V_x$ is larger than $V_{ref}$, then, it can be inferred that the first terminal is the negative terminal of the MIC if the detected $V_x$ is greater than $V_{ref}$.

It can be seen that through comparison of $V_x$ and $V_{ref}$, only one detection is required to accurately determine the positive and negative terminals of the first and second terminals of the MIC, thereby determining whether the MIC is connected positively or reversely.

In comparison, in the prior art, the excitation current is injected from the positive terminal of the MIC, and the negative terminal of the MIC is grounded, then the detected voltage at the positive terminal of the MIC is the positive voltage; the excitation current is injected from the negative terminal of the MIC, and the positive terminal of the MIC is grounded, then the detected voltage at the negative terminal of the MIC is the reverse voltage; for different types of MIC, it is possible that the reverse voltage of one type of MIC is greater than the positive voltage of another type of MIC; the positive voltage and reverse voltage of some similar MICs are not clearly distinguished, and at the same time, it is unknowable whether the terminal connected to the excitation current is positive or negative and whether the detected terminal is positive or negative; therefore, the existing method is required to inject the current once into the positive terminal and the negative pin of the MIC for detection, so as to perform comparison and judgment. For this reason, two detections must be introduced in the prior art.

In comparison, the present invention discovers and utilizes the circuit characteristic that the negative terminal of the MIC is connected to the common terminal of the two speaker circuits, which breaks through the technical prejudice in the prior art that the positive and negative terminals of the MIC should be judged directly to detect the voltage of the corresponding positive and negative terminals, so that positive and negative terminals may be judged only by one detection. It can be seen that the present invention may effectively simplify the processing flow and improve the processing efficiency; at the same time, since only one measurement is required, the present invention no longer needs two sets of detection device, which can be beneficial to cost saving.

In the present invention, since the present invention does not require two detection, the detected data may be directly compared, and digital processing and buffering are no longer necessary means while being beneficial to realize other low-cost detection methods, which are not limited to ADC methods; it can be seen that the present invention may also help reduce costs. For this reason, a further optional solution of the present invention may use the comparator to directly compare the detected current voltage with the reference voltage value, which further reduces the cost of the device.

BRIEF DESCRIPTION OF THE DRAWINGS

To describe the technical solutions in the embodiments of the present invention or in the prior art more clearly, accompanying drawings required to describe the embodiments or the prior art are briefly described below. It is obvious that the accompanying drawings described below are only some embodiments of the present invention. It is apparent to those of ordinary skill in the art that other drawings may be further obtained based on the accompanying drawings without inventive effort.

DESCRIPTION OF REFERENCE NUMERALS

1—Judging circuit for positive and negative terminals of MIC of an earphone;
11—Comparison module;
111—Comparator;
12—Control module;
121—Control chip;
2—Earphone;
21—MIC;
22—Speaker circuit;
3—Audio processing module;
4—Electronic device;
41—Interface assembly;
R1—First equivalent resistor;
R2—Second equivalent resistor;
S1—Analog switch.

DETAILED DESCRIPTION OF THE EMBODIMENTS

Clear and intact description will be made on technical schemes in the embodiments of the present invention below in combination with drawings in the embodiments of the present invention. Obviously, the described embodiments are merely a part of embodiments of the present invention and are not all the embodiments. Based on the embodiments of the present invention, all the other embodiments obtained by those of ordinary skill in the art without inventive effort are within the scope of the present invention.

Terms "first", "second", "third", "fourth", and the like (if any) in the specification and claims of the present invention and the foregoing accompanying drawings are used to distinguish similar objects, but do not need to be used for describing a specific sequence or an order. It should be understood that data used in this way can be interchanged under appropriate circumstances, so that the embodiments of the present invention described herein can be implemented in an order other than those illustrated or described herein. In addition, terms "including", "having", and any variations thereof are intended to cover non-exclusive inclusions, for example, processes, methods, systems, products, or devices that contain a series of steps or units need not be limited to those clearly listed steps or units, but may include other steps or units not explicitly listed or inherent to these processes, methods, products, or devices.

The technical solutions of the present invention are described in detail below with reference to the specific embodiments. The following several embodiments may be combined with each other, and a same or similar concept or process may not be described again in some embodiments.

Figure 1:
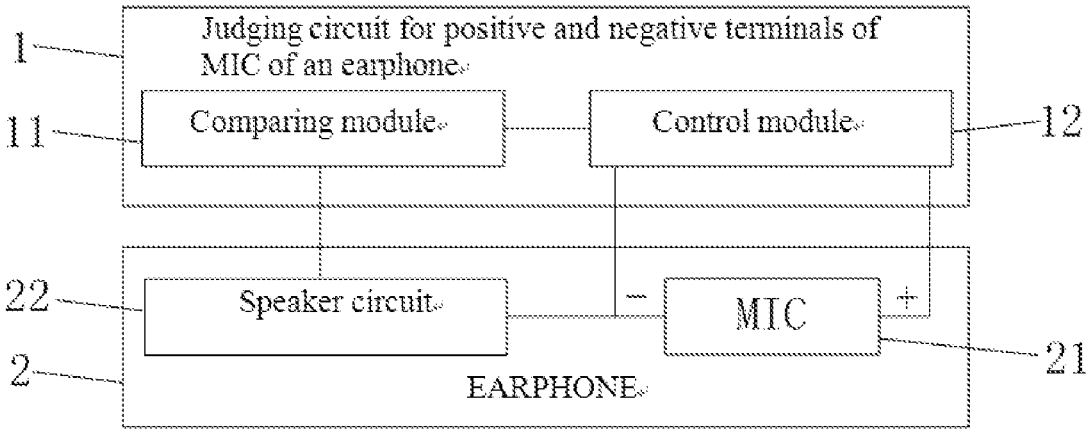
FIG. 1 is a circuit diagram one of a judging circuit for positive and negative terminals of MIC of an earphone and an earphone in an embodiment of the present invention.
Figure 2:
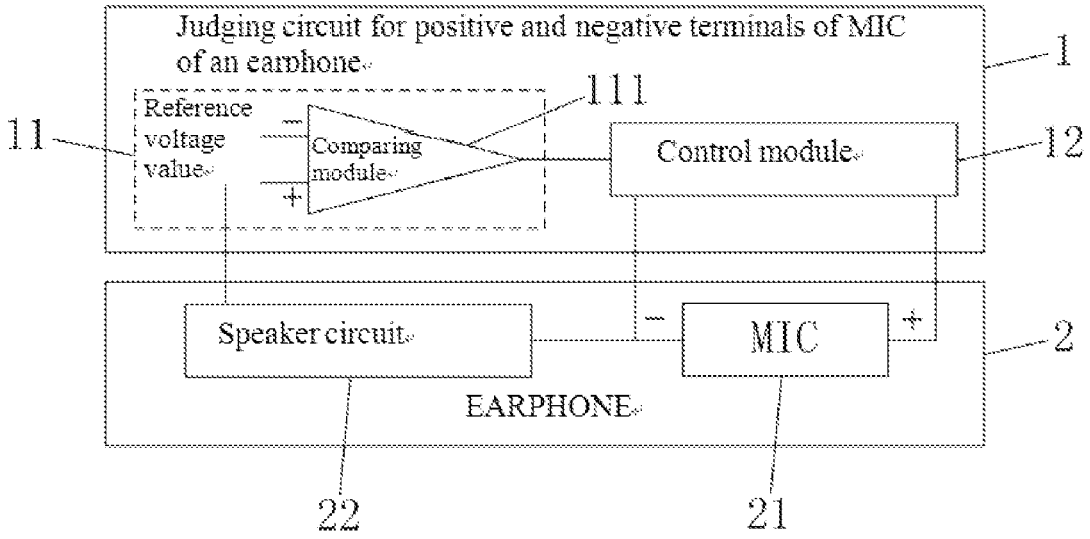
FIG. 2 is a circuit diagram two of a judging circuit for positive and negative terminals of MIC of an earphone and an earphone in an embodiment of the present invention.
Figure 3:
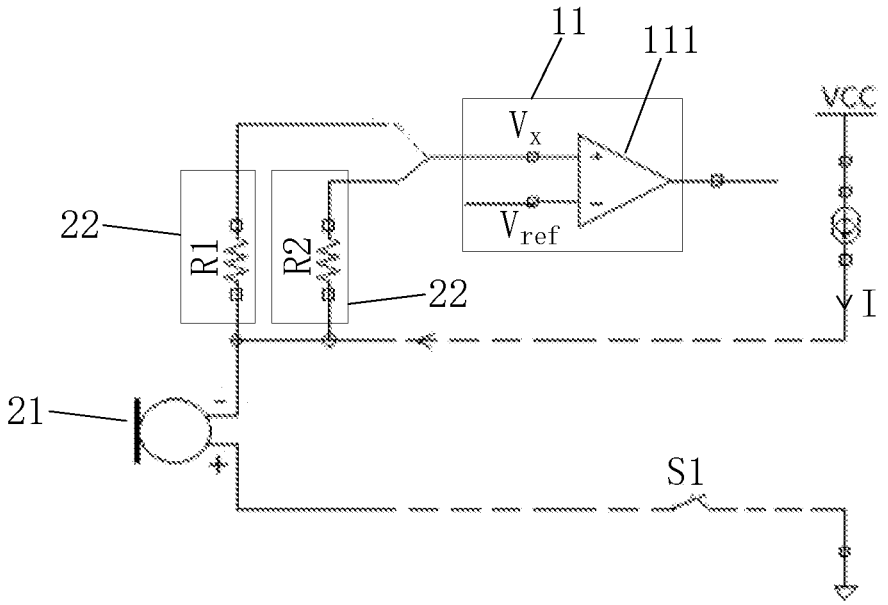
FIG. 3 is a principle diagram one of a judging circuit for positive and negative terminals of MIC of an earphone in an embodiment of the present invention.
Figure 4:
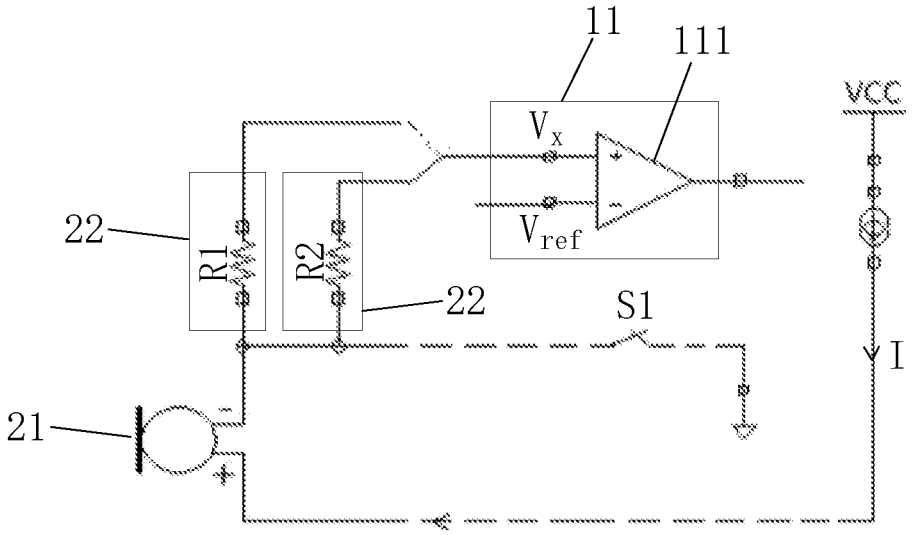
FIG. 4 is a principle diagram two of a judging circuit for positive and negative terminals of MIC of an earphone in an embodiment of the present invention.

FIG. 1 is a circuit diagram one of a judging circuit for positive and negative terminals of MIC of an earphone and an earphone in an embodiment of the present invention; FIG. 2 is a circuit diagram two of a judging circuit for positive and negative terminals of MIC of an earphone and an earphone in an embodiment of the present invention; FIG. 3 is a principle diagram one of a judging circuit for positive and negative terminals of MIC of an earphone in an embodiment of the present invention; FIG. 4 is a principle diagram two of a judging circuit for positive and negative terminals of MIC of an earphone in an embodiment of the present invention.

The judging circuit for positive and negative terminals of MIC of an earphone involved in an embodiment of the present invention may be applied to the MIC in the Type-C earphone.

With reference to FIGS. 1 to 4, the judging circuit 1 for positive and negative terminals of MIC of an earphone may be applied to the Type-C earphone, i.e., an earphone 2 being a Type-C earphone, wherein the earphone 2 may include an MIC 21 and a speaker circuit 22.

The MIC 21 may be understood as a device or combination of devices that collects and transmits external sound signals, which has a positive terminal and a negative terminal. The positive terminal and negative terminal of the MIC 21 may be understood as: after the positive terminal is connected to a positive terminal of the audio processing module and the negative terminal and a negative terminal of the audio processing module share the same ground, the transmission of external sound signals may be realized, so that the audio processing module may perform related processing on the sound signal.

The speaker circuit 22 may be an electronic circuit that may receive audio signals from the electronic device connected to the earphone and emit corresponding sounds to the outside. For example, an earphone speaker capable of emitting sound waves may be included, and devices that amplify, filter, transmit, buck-boost and other arbitrary functions on audio signals and their connecting devices are further included.

Each earphone may have two speaker circuits 22 correspondingly, which are a left ear speaker circuit 22 and a right ear speaker circuit 22 respectively. Each earphone may have one MIC 21.

In addition, the MIC 21 may be configured in a housing with any speaker circuit 22, or separately in a housing, as long as the connection relationship involved in the context or the way of data transmission is realized; no matter how it is designed in space, it does not depart from the relevant description of the embodiment of the present invention.

In the Type-C earphone, a negative terminal of the MIC 21 is connected to a common terminal of the two speaker circuits 22. For details, please refer to the pin definition and internal circuit of Type-C earphones, which are common knowledge known in the art, and hence will not be described in detail through circuit diagrams or text. And therefore, any solution that applies the solutions involved in the following of the embodiments of the present invention to the Type-C earphone does not depart from the scope of the present invention.

Moreover, the judgment of the positive and negative terminals of the MIC 21 may also be understood as the judgment for whether the MIC 21 is positively connected or reversely connected, wherein when the positive connection is determined, for example, it can be understood that the determined positive terminal of the MIC 21 is currently connected to an MIC pin of the audio processing circuit, and the recognized negative of the MIC 21 is currently connected to a ground pin of the audio processing circuit; otherwise, when the reverse connection is determined, for example, it can be understood that the determined positive terminal of the MIC 21 is currently connected to the ground pin of the audio processing circuit, and the recognized negative terminal of the MIC is currently connected to the MIC pin of the audio processing circuit.

With reference to FIGS. 1 to 4, the judging circuit 1 for positive and negative terminals of an earphone MIC includes a comparison module 11 and a control module 12;

the control module 12 is directly or indirectly connected to two terminals of the MIC 21, is configured to control any one first terminal of the two terminals of the MIC 21 to inject an excitation current I, and control the other second terminal of the two terminals of the MIC 21 to be connected to the ground.

Through the above control, the MIC 21 may be made to form a positive connection path or a reverse connection path, and further, may provide a basis for voltage collection and comparison. At the same time, since the prior art is required to inject the excitation current into the MIC 21, the method of controlling the injection of the excitation current and controlling the grounding may be the method in the prior art.

In an embodiment, a first terminal and a second terminal of the MIC 21 may be respectively connected to an output terminal of the control module 12, and the control module 12 may output the excitation current to the first terminal and the second terminal of the MIC 21 through corresponding output terminals.

In an embodiment, the first terminal and the second terminal of the MIC 21 may be connected to the ground via an analog switch S1 respectively. When the control module 12 controls one of the analog switches to close, the corresponding first terminal or the second terminal may be connected to the ground.

In another embodiment, since the subsequent implementation of the embodiment of the present invention only needs to inject the excitation current once, the connection method and principle of action at both terminals of MIC 21 may be determined as grounding one terminal and injecting the excitation current into the other terminal without remaining both terminals being used for grounding and being injected with the excitation current, which may also be beneficial to a simplified design of the circuit.

With reference to FIGS. 3 and 4, in actual implementation, as long as at least one of the path forms in FIGS. 3 and 4 is realized through control, regardless of whether the two path forms may be switched, it can fall within the scope of the embodiment of the present invention.

The comparison module 11 is connected to at least one of two speaker circuits 22 of the earphone to collect a current voltage of a corresponding position in the speaker circuit 22.

The comparison module 11 is further connected to the control module 12 to send the comparison result information to the control module 12.

The comparison module 11 is configured to compare the current voltage with a preset reference voltage value after the excitation current I is injected into the first terminal and the second terminal is grounded to obtain comparison result information.

The reference voltage value may be understood as being preset as a minimum value of the reverse connection voltage, or another voltage value determined according to the minimum value. At the same time, the reference voltage value may be an empirical value determined by man or machine. In an embodiment, the parameters for the specific excitation current, analog switch, resistor in the speaker circuit, etc. may be determined correspondingly to the reference voltage value.

In a specific example, when the excitation current is 1 mA, the corresponding reference voltage value may be 100 mV.

Since the reference voltage value is a value that needs to be determined in the prior art, any reference voltage value generated under any logic may be applied to the present embodiment to form a feasible implementation. In addition, whether it is the existing value logic of the reference voltage value or the value logic that has a certain improvement, it does not depart from the description of the present embodiment.

The comparison result information may be understood as any form of information that may characterize which of the current voltage and the reference voltage is larger.

In an embodiment, the comparison result information may use two different kinds of information to characterize two different comparison results, e.g., a first comparison result information and a second comparison result information; correspondingly, the control module may directly learn which comparison result is when receiving the first comparison result information or the second comparison result information.

In another embodiment, the comparison result information may also be configured to send out information only in the case of one comparison result, and not send out information in the case of another comparison result; correspondingly, the control module may be configured to determine that the current voltage is larger than the reference voltage value if the information is received, and determine that the current voltage is smaller than the reference voltage value if the information is not received.

It can be seen that according to the different circuit configurations of the comparison module 11 and the control module 12, the information form itself of the comparison result information and the sent logic may be various.

The control module 12 is further configured to judge whether the first terminal and the second terminal is the positive terminal or the negative terminal according to the comparison result information, so as to determine whether the MIC 21 is positively connected or reversely connected.

In an embodiment, if the comparison result information includes a first comparison result information, the comparison module 11 is specifically configured to send the first comparison result information to the control module when the current voltage is higher than the reference voltage value.

Correspondingly, the control module 12 is specifically configured to determine, according to the first comparison result information, that the first terminal is the negative terminal of the MIC 21 and the second terminal is the positive terminal of the MIC 21.

In an embodiment, if the comparison result information includes a second comparison result information, the comparison module 11 is specifically configured to send the second comparison result information to the control module 12 when the current voltage is higher than the reference voltage value.

Correspondingly, the comparison module 11 is specifically configured to determine, according to the second comparison result information, that the first terminal is the positive terminal of the MIC 21 and the second terminal is the negative terminal of the MIC 21.

In actual implementation, if a high-level signal is used to characterize the first comparison result information, the control module 12 may receive the high-level signal from the comparison module 11 when the current voltage is higher than the reference voltage value of, for example, 100 mV, so that the first terminal is determined as the negative terminal of the MIC 21, and the second terminal is determined as the positive terminal of the MIC 21; if a low-level signal is used to characterize the second comparison result information, the control module 12 may receive the low-level signal from the comparison module 11 when the current voltage is lower than the reference voltage value of, for example, 100 mV, so that the first terminal is determined as the positive terminal of the MIC 21, and the second terminal is determined as the negative terminal of the MIC 21.

In an embodiment, with reference to FIGS. 2 to 3, the comparison module 11 includes a comparator 111, a first input terminal of the comparator 111 inputs the current voltage, a second input terminal of the comparator 111 inputs the reference voltage value, and an output terminal of the comparator 111 is connected to the control module to send the comparison result information to the control module. Specifically, the above high-level signal or low-level signal may be output.

At the same time, the present embodiment does not exclude the method of using the ADC method to detect to obtain the current voltage and compare the current voltage with the reference voltage value.

In the speaker circuit 22, an earphone speaker may be provided between the first input terminal of the comparator and the common terminal of the two speaker circuits, and the earphone speaker may be characterized by equivalent resistors, such as a first equivalent resistor R1 and a second equivalent resistor R2 shown in the figure. It can be seen that the current voltage collected by the comparator may not be the voltage of the common terminal itself, but has a certain correlation with the voltage of the common terminal. In an embodiment, due to the large input impedance of the comparator, the current voltage collected by the comparator here may also be equal to the voltage at the common terminal; correspondingly, what the comparator compares is the voltage of the common terminal and the reference voltage value.

If the first terminal of the MIC 21 is connected to the control module 12 through an SBU1 pin in an interface assembly of the earphone, the second terminal of the MIC 21 is connected to the control module 12 through an SBU2 pin in the interface assembly of the earphone. At the same time, when $V_{MIC}$ represents the voltage drop across the MIC, $V_{switch}$ represents the voltage drop of the analog switch and $V_x$ represents the current measured voltage, and $V_{ref}$ represents the preset voltage value associated with the minimum reverse voltage, then:

in an embodiment shown in FIG. 3, if the first terminal input with the excitation current I is the negative terminal of the MIC and the detected $V_x$ is the voltage of the negative terminal of the MIC, i.e., if $V_x$ is larger than the minimum reverse voltage when in reverse connection, i.e., $V_x$ is larger than $V_{ref}$, then, it can be inferred that the first terminal is the negative terminal of the MIC if the detected $V_x$ is greater than $V_{ref}$.

In an embodiment shown in FIG. 4, if the first terminal input with the excitation current is the positive terminal of the MIC, $V_x$ is the voltage of the negative terminal of the MIC, and $V_x=V_{switch}$, and since $V_{ref}$ is much larger than $V_{switch}$ at this time, then: the current voltage detected at this time is equivalent to the result of multiplying the on-resistance of the analog switch K1 by 1 mA; since the on-resistance is normally smaller than 100 milliohms, the current voltage $V_x$ at this time should be much smaller than the reference voltage value $V_{ref}$, i.e., $V_x$ is much smaller than $V_{ref}$, then, it is inferred that the first terminal is the positive terminal of the MIC if it is detected that $V_x$ is smaller than $V_{ref}$.

Figure 5:
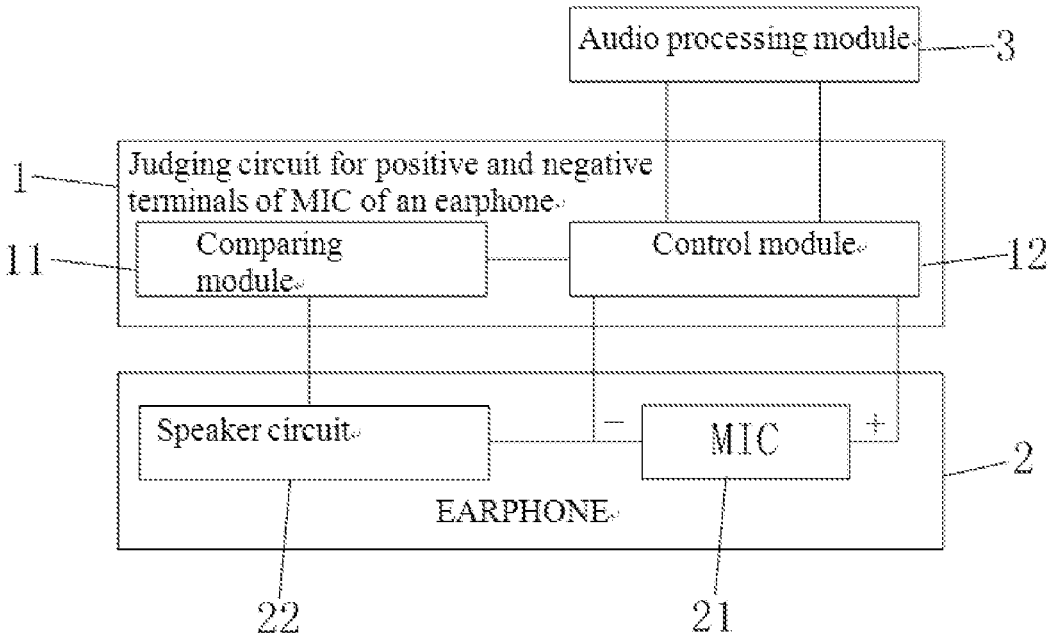
FIG. 5 is a circuit diagram of a judging circuit for positive and negative terminals of MIC of an earphone, an earphone and an audio processing module in an embodiment of the present invention.

FIG. 5 is a circuit diagram of a judging circuit for positive and negative terminals of MIC of an earphone, an earphone and an audio processing module in an embodiment of the present invention.

With reference to FIG. 5, the control module 12 is further connected to an audio processing module 3.

The audio processing module 3 may be any circuit that performs audio processing on the signal transmitted from the earphone. In an embodiment, it can also be understood, for example, that the signal processed by the audio processing module 3 may be recognized by a processor of an electronic device and used for information processing.

The audio processing module 3 has the MIC pin and the ground pin, as mentioned above, wherein when in positive connection, the MIC pin may be connected to the positive terminal of the MIC, and the ground pin may be connected to the negative terminal of the MIC.

The control module 12 is further configured to control the positive terminal of the MIC 21 to be connected to the MIC pin of an audio processing module 3, after determining the positive terminal and the negative terminal of the first terminal and the second terminal, to employ the MIC pin to receive a signal transmitted by the MIC 21 and control the negative terminal of the MIC 21 to be connected to the ground pin of the audio processing module 3.

Figure 6:
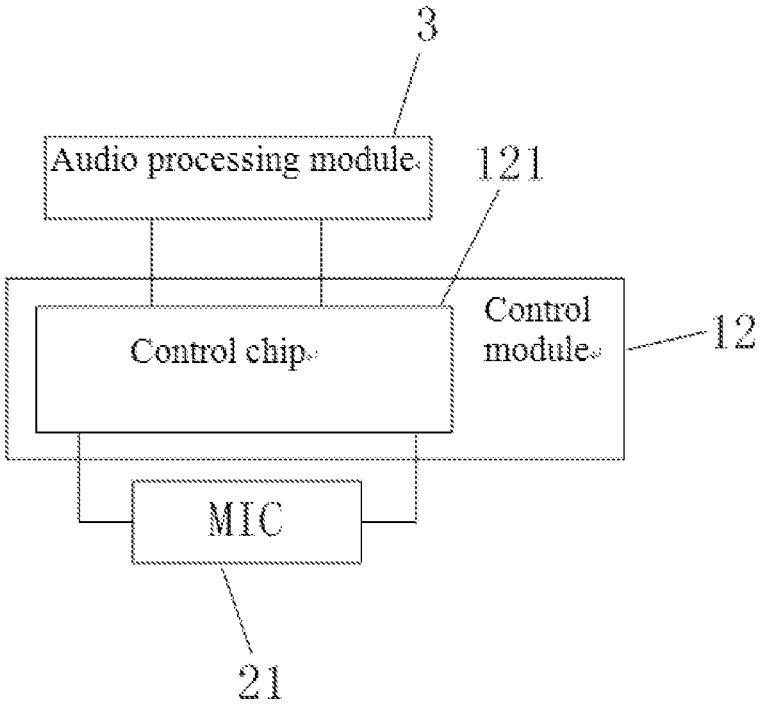
FIG. 6 is a circuit diagram one of a control module in an embodiment of the present invention.

FIG. 6 is a circuit diagram one of a control module in an embodiment of the present invention.

With reference to FIG. 6, the control module 12 may include a control chip 121, and the control chip may be connected to the positive terminal of the MIC 21, the negative terminal of the MIC 21, the MIC pin of the audio processing module 3 and the ground pin of the MIC pin by four ports. Further, the connection between the positive terminal of MIC 21 and the MIC pin of the audio processing module 3, and the connection between the negative terminal of MIC 21 and the ground pin of the audio processing module 3 are realized through the definition and conduction of each port in the control chip 121.

Figure 7:
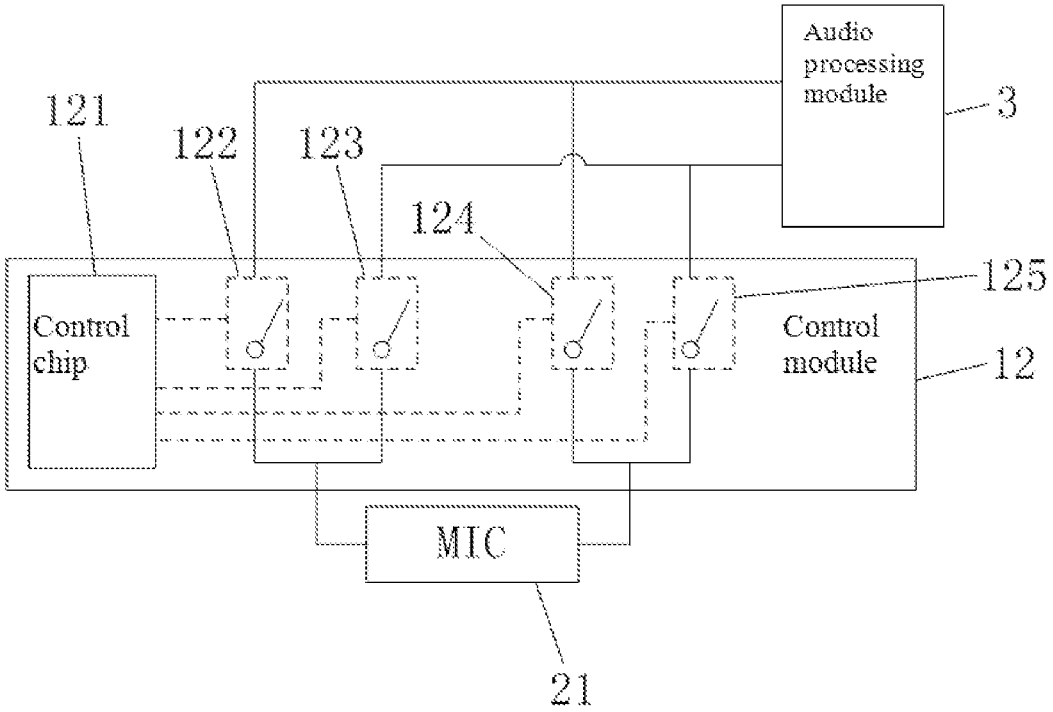
FIG. 7 is a circuit diagram two of a control module in an embodiment of the present invention.

FIG. 7 is a circuit diagram two of a control module in an embodiment of the present invention.

With reference to FIG. 7, the control module 12 may include the control chip 121, and further include a first control switch 122, a second control switch 123, a third control switch 124 and a fourth control switch 125 controlled by the control chip 121; the positive terminal of the MIC 21 may be connected to the MIC pin of the audio processing module 3 and the negative terminal of the MIC 21 may be connected to the ground pin of the audio processing module 3 through the control of the four control switches.

Since the prior art is also required to realize the connection between the positive terminal and the negative terminal of the MIC 21 and the corresponding pins of the audio processing module 3, the implementation of any existing manner may meet the above requirements without departing from the description of the embodiments of the present invention.

It can be seen that the judging circuit for positive and negative terminals of MIC of an earphone provided by the present invention discovers and utilizes the circuit characteristic that the negative terminal of the MIC is connected to the common terminal of the two speaker circuits, which breaks through the technical prejudice in the prior art that the positive and negative terminals of the MIC should be judged directly to detect the voltage of the corresponding positive and negative terminals, so that positive and negative terminals may be judged only by one detection. It can be seen that the present invention may effectively simplify the processing flow and improve the processing efficiency; at the same time, since only one measurement is required, the present invention no longer needs two sets of detection device, which can be beneficial to cost saving.

In the present invention, since the present invention does not require two detection, the detected data may be directly compared, and digital processing and buffering are no longer necessary means while being beneficial to realize other low-cost detection methods, which are not limited to ADC methods; it can be seen that the present invention may also help reduce costs. For this reason, a further optional solution of the present invention may use the comparator to directly compare the detected current voltage with the reference voltage value, which further reduces the cost of the device.

Figure 8:
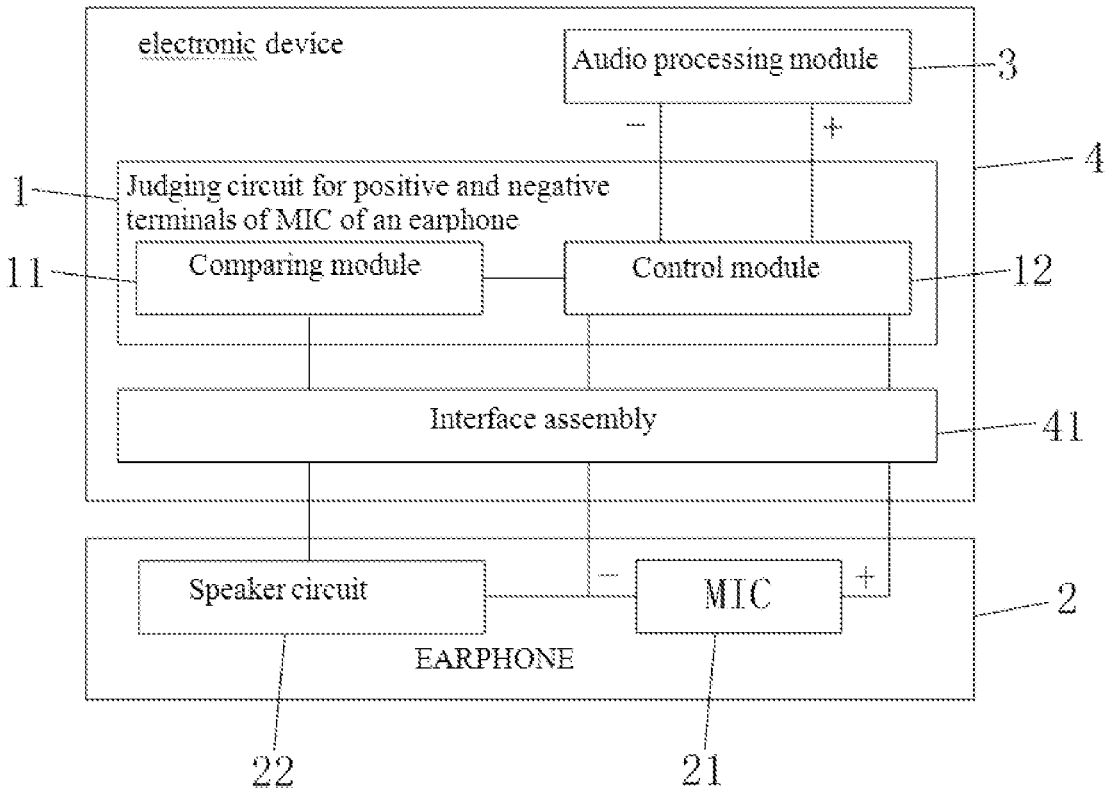
FIG. 8 is a circuit diagram of an electronic device and an earphone in an embodiment of the present invention.

FIG. 8 is a circuit diagram of an electronic device and an earphone in an embodiment of the present invention.

With reference to FIG. 8, an electronic device 4 capable of being connected to the earphone is provided, including the judging circuit 1 for positive and negative terminals of an earphone MIC involved in each of above optional solutions.

In an embodiment, the electronic device 4 further includes an interface assembly 41, the interface assembly 41 connecting the control module 12 and the comparison module 11 respectively.

When the earphone 2 is connected to the interface assembly 41, the control module 12 is respectively connected to two terminals of the MIC 21 through the interface assembly 41.

When the earphone 2 is connected to the interface assembly 41, the comparison module 11 is connected to at least one of the two speaker circuits 22 through the interface assembly 41.

In actual implementation, the interface assembly 41 may include a first interface component connected to the first terminal of the control module 12 and a second interface component connected to the second terminal of the control module 12, wherein the first interface component may be connected to the first terminal and the second terminal of the MIC 21 when the earphone 2 is connected to the electronic device 4, for example, may be connected to the SBU1 pin and the SBU2 pin of the earphone.

In an embodiment, the electronic device 4 is any one of a mobile phone, a computer, a tablet computer, and a call device.

Figure 9:
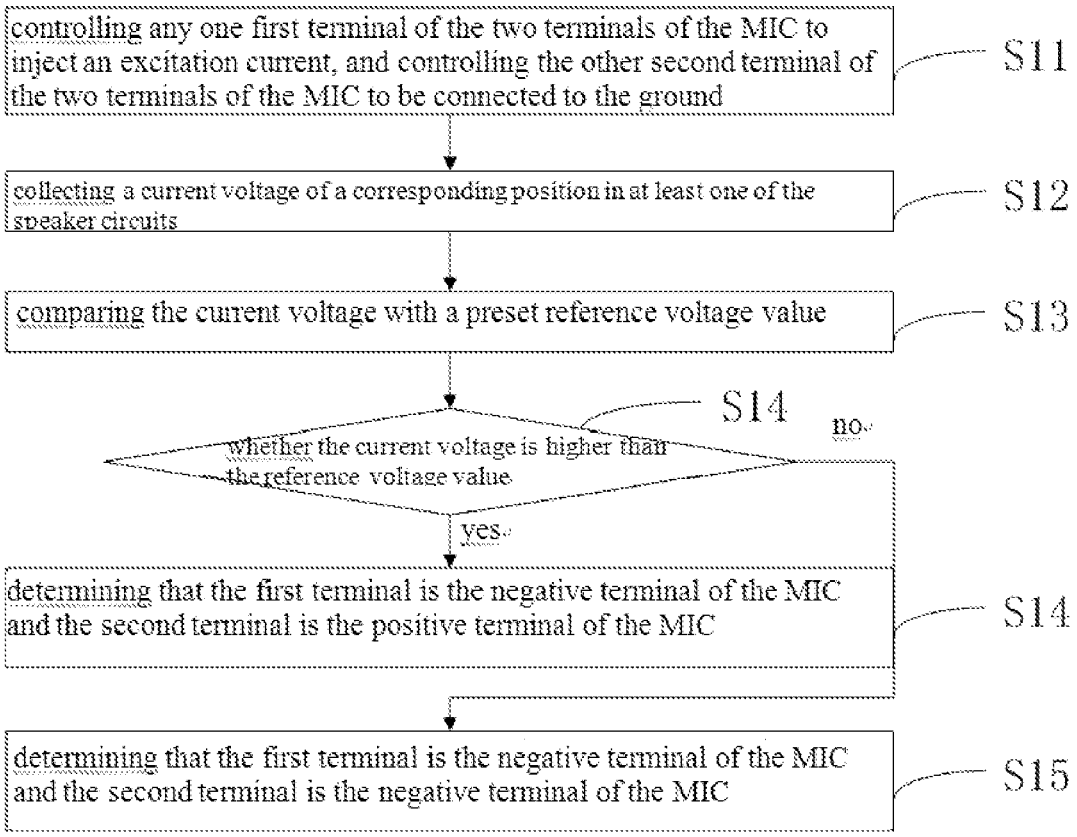
FIG. 9 is a flow chart of a judging method for positive and negative terminals of MIC of an earphone in an embodiment of the present invention.

FIG. 9 is a flow chart of a judging method for positive and negative terminals of MIC of an earphone in an embodiment of the present invention.

With reference to FIG. 9, a judging method for positive and negative terminals of MIC of an earphone is provided, including:

S11: controlling any one first terminal of the two terminals of the MIC to inject an excitation current, and controlling the other second terminal of the two terminals of the MIC to be connected to the ground.

S12: collecting a current voltage of a corresponding position in at least one of the speaker circuits.

S13: comparing the current voltage with a preset reference voltage value.

S14: judging whether the current voltage is higher than the reference voltage value, if yes, a step S15 is performed, including: determining that the first terminal is the negative terminal of the MIC and the second terminal is the positive terminal of the MIC;

if no, a step S16 is performed, including: determining that the first terminal is the positive terminal of the MIC and the second terminal is the negative terminal of the MIC.

Moreover, the method shown in the present embodiment may correspondingly be applied to implement the technical solutions of the embodiments shown in FIGS. 1 to 8, with similar implementation principles, technical effects, and meanings of terms and that will not be repeated here.

In summary, the judging circuit for positive and negative terminals of MIC of an earphone provided by the present invention discovers and utilizes the circuit characteristic that the negative terminal of the MIC is connected to the common terminal of the two speaker circuits, which breaks through the technical prejudice in the prior art that the positive and negative terminals of the MIC should be judged directly to detect the voltage of the corresponding positive and negative terminals, so that positive and negative terminals may be judged only by one detection. It can be seen that the present invention may effectively simplify the processing flow and improve the processing efficiency; at the same time, since only one measurement is required, the present invention no longer needs two sets of detection device, which can be beneficial to cost saving.

In the present invention, since the present invention does not require two detection, the detected data may be directly compared, and digital processing and buffering are no longer necessary means while being beneficial to realize other low-cost detection methods, which are not limited to ADC methods; it can be seen that the present invention may also help reduce costs. For this reason, a further optional solution of the present invention may use the comparator to directly compare the detected current voltage with the reference voltage value, which further reduces the cost of the device.

In the last, it should be noted that the above embodiments are only used to illustrate the technical solutions of the present invention, not to limit them; although the present invention has been described in detail with reference to the foregoing embodiments, those of ordinary skill in the art should understand that they can still modify the technical solutions described in the foregoing embodiments, or equivalently replace some or all of the technical features; these modifications or replacements do not cause the essence of the corresponding technical solutions to deviate from the scope of the technical solutions of the embodiments of the present invention.

What is claimed is:

1. A judging circuit for positive and negative terminals of an earphone MIC of a Type-C earphone, wherein a negative terminal of the MIC is connected to a common terminal of two speaker circuits, the judging circuit for positive and negative terminals of an earphone MIC comprising a comparison module and a control module;

the control module is directly or indirectly connected to two terminals of the MIC, and is configured to control any one first terminal of the two terminals of the MIC to inject an excitation current, and control the other second terminal of the two terminals of the MIC to be connected to the ground via an analog switch;

the comparison module is connected to at least one of the two speaker circuits of the earphone to collect a current voltage of a corresponding position in the speaker circuit;

the comparison module is configured to compare the current voltage with a preset reference voltage value after the excitation current is injected into the first terminal and the second terminal is grounded to obtain comparison result information; the reference voltage value is determined according to a minimum reverse voltage under the excitation current;

the comparison module is further connected to the control module to send the comparison result information to the control module; and the control module is further configured to judge whether the first terminal and the second terminal is the positive terminal or the negative terminal according to the comparison result information.

2. The judging circuit for positive and negative terminals of an earphone MIC according to claim 1, wherein the comparison result information comprises a first comparison result information, and the comparison module is specifically configured to send the first comparison result information to the control module when the current voltage is higher than the reference voltage value; and the control module is specifically configured to determine, according to the first comparison result information, that the first terminal is the negative terminal of the MIC and the second terminal is the positive terminal of the MIC.

3. The judging circuit for positive and negative terminals of an earphone MIC according to claim 2, wherein the comparison module comprises a comparator, a first input terminal of the comparator inputs the current voltage, a second input terminal of the comparator inputs the reference voltage value, and an output terminal of the comparator is connected to the control module to send the comparison result information to the control module.

4. The judging circuit for positive and negative terminals of an earphone MIC according to claim 2, wherein the control module is further configured to control the positive terminal of the MIC to be connected to an MIC pin of an audio processing module, after determining the positive terminal and the negative terminal of the first terminal and the second terminal, to employ the MIC pin to receive a signal transmitted by the MIC and control the negative terminal of the MIC to be connected to a ground pin of the audio processing module.

5. The judging circuit for positive and negative terminals of an earphone MIC according to claim 1, wherein the comparison result information comprises a second comparison result information, and the comparison module is specifically configured to send the second comparison result information to the control module when the current voltage is lower than the reference voltage value; and the comparison module is specifically configured to determine, according to the second comparison result information, that the first terminal is the positive terminal of the MIC and the second terminal is the negative terminal of the MIC.

6. The judging circuit for positive and negative terminals of an earphone MIC according to claim 5, wherein the comparison module comprises a comparator, a first input terminal of the comparator inputs the current voltage, a second input terminal of the comparator inputs the reference voltage value, and an output terminal of the comparator is connected to the control module to send the comparison result information to the control module.

7. The judging circuit for positive and negative terminals of an earphone MIC according to claim 5, wherein the control module is further configured to control the positive terminal of the MIC to be connected to an MIC pin of an audio processing module, after determining the positive terminal and the negative terminal of the first terminal and the second terminal, to employ the MIC pin to receive a signal transmitted by the MIC and control the negative terminal of the MIC to be connected to a ground pin of the audio processing module.

8. The judging circuit for positive and negative terminals of an earphone MIC according to claim 1, wherein the comparison module comprises a comparator, a first input terminal of the comparator inputs the current voltage, a second input terminal of the comparator inputs the reference voltage value, and an output terminal of the comparator is connected to the control module to send the comparison result information to the control module.

9. The judging circuit for positive and negative terminals of an earphone MIC according to claim 8, wherein the first input terminal of the comparator is connected to the common terminal of the two speaker circuits via an earphone speaker.

10. The judging circuit for positive and negative terminals of an earphone MIC according to claim 1, wherein the control module is further configured to control the positive terminal of the MIC to be connected to an MIC pin of an audio processing module, after determining the positive terminal and the negative terminal of the first terminal and the second terminal, to employ the MIC pin to receive a signal transmitted by the MIC and control the negative terminal of the MIC to be connected to a ground pin of the audio processing module.

11. An electronic device capable of being connected to an earphone, comprising the judging circuit for positive and negative terminals of an earphone MIC according to claim 1.

12. The electronic device capable of being connected to an earphone according to claim 11, further comprising an interface assembly, the interface assembly being connected to the control module and the comparison module respectively;

when the earphone is connected to the interface assembly, the control module is respectively connected to two terminals of the MIC through the interface assembly; and when the earphone is connected to the interface assembly, the comparison module is connected to at least one of the two speaker circuits through the interface assembly.

13. The electronic device capable of being connected to the earphone according to claim 12, wherein the electronic device is any one of a mobile phone, a computer, a tablet computer, and a call device.

14. The electronic device capable of being connected to the earphone according to claim 11, wherein the electronic device is any one of a mobile phone, a computer, a tablet computer, and a call device.

15. The electronic device capable of being connected to an earphone according to claim 11, wherein the comparison result information comprises a first comparison result information, and the comparison module is specifically configured to send the first comparison result information to the control module when the current voltage is higher than the reference voltage value; and the control module is specifically configured to determine, according to the first comparison result information, that the first terminal is the negative terminal of the MIC and the second terminal is the positive terminal of the MIC.

16. The electronic device capable of being connected to an earphone according to claim 11, wherein the comparison result information comprises a second comparison result information, and the comparison module is specifically configured to send the second comparison result information to the control module when the current voltage is lower than the reference voltage value; and the comparison module is specifically configured to determine, according to the second comparison result information, that the first terminal is the positive terminal of the MIC and the second terminal is the negative terminal of the MIC.

17. The electronic device capable of being connected to an earphone according to claim 11, wherein the comparison module comprises a comparator, a first input terminal of the comparator inputs the current voltage, a second input terminal of the comparator inputs the reference voltage value, and an output terminal of the comparator is connected to the control module to send the comparison result information to the control module.

18. The electronic device capable of being connected to an earphone according to claim 11, wherein the first input terminal of the comparator is connected to the common terminal of the two speaker circuits via an earphone speaker.

19. The electronic device capable of being connected to an earphone according to claim 11, wherein the control module is further configured to control the positive terminal of the MIC to be connected to an MIC pin of an audio processing module, after determining the positive terminal and the negative terminal of the first terminal and the second terminal, to employ the MIC pin to receive a signal transmitted by the MIC and control the negative terminal of the MIC to be connected to a ground pin of the audio processing module.

20. A judging method for positive and negative terminals of an earphone MIC of a Type-C earphone, wherein a negative terminal of the MIC is connected to a common terminal of two speaker circuits, the judging method for positive and negative terminals of an earphone MIC comprising:

controlling any one first terminal of the two terminals of the MIC to inject an excitation current, and controlling the other second terminal of the two terminals of the MIC to be connected to the ground;

collecting a current voltage of a corresponding position in at least one of the speaker circuits;

comparing the current voltage with a preset reference voltage value;

determining that the first terminal is the negative terminal of the MIC and the second terminal is the positive terminal of the MIC if the current voltage is higher than the preset reference voltage value; and determining that the first terminal is the positive terminal of the MIC and the second terminal is the negative terminal of the MIC if the current voltage is lower than the preset reference voltage value.

* * * * *